US007753709B2

(12) United States Patent
Silkey et al.

(10) Patent No.: US 7,753,709 B2
(45) Date of Patent: Jul. 13, 2010

(54) CALL CORD CONNECTION SYSTEM WITH MECHANICAL COUPLING MECHANISM

(75) Inventors: Carl J. Silkey, Hubbardston, MA (US); Josef Prokop, Popovice (CZ)

(73) Assignee: SimplexGrinnell LP, Westminster, MA (US)

( * ) Notice: Subject to any disclaimer, the term of this patent is extended or adjusted under 35 U.S.C. 154(b) by 7 days.

(21) Appl. No.: 12/200,448

(22) Filed: Aug. 28, 2008

(65) Prior Publication Data

US 2009/0264006 A1 Oct. 22, 2009

Related U.S. Application Data

(60) Provisional application No. 61/046,808, filed on Apr. 22, 2008.

(51) Int. Cl.
*H01R 13/627* (2006.01)

(52) U.S. Cl. ..... 439/350; 439/923

(58) Field of Classification Search ..... 439/350, 439/362, 923, 909, 358
See application file for complete search history.

(56) References Cited

U.S. PATENT DOCUMENTS 4,225,852 A * 9/1980 Waters et al. ..... 340/286.07
4,228,426 A * 10/1980 Roberts ..... 340/573.4
5,713,752 A * 2/1998 Leong et al. ..... 439/358
6,149,451 A * 11/2000 Weber ..... 439/358
6,910,911 B2 * 6/2005 Mellott et al. ..... 439/358
6,917,293 B2 * 7/2005 Beggs ..... 340/573.1
2002/0186123 A1 * 12/2002 Kivisto et al. ..... 340/286.07
2004/0178910 A1 * 9/2004 Egger ..... 340/556

* cited by examiner

*Primary Examiner*—Hae Moon Hyeon
(74) *Attorney, Agent, or Firm*—Grossman Tucker Perreault & Pfleger

(57) ABSTRACT

A call cord system and connection are disclosed. The system can be implemented in any number of situations where summoning assistance from a remote location is desirable, such as in a healthcare provider setting. In addition, the call cord connection allows the cord to be securely engaged for its intended operation, without concern that the cord will unintentionally become disconnected. However, given sufficient force, the call cord connection further allows the cord to be disconnected from the patient station by the patient or staff without damaging either the call cord itself or the patient station. Such an intentional disconnect can be used, for instance, to signal a patient or staff emergency and a corresponding response, when normal call signaling is not possible (e.g., the patient is not able to depress the call button) or higher priority attention is needed for whatever reason.

21 Claims, 6 Drawing Sheets

CALL CORD CONNECTION SYSTEM WITH MECHANICAL COUPLING MECHANISM

RELATED APPLICATION

The present application claims the benefit of U.S. Provisional Application No. 61/046,808, filed Apr. 22, 2008, which is herein incorporated in its entirety by reference.

TECHNICAL FIELD

The present application relates to connectors and, more particularly, to call cord connections.

BACKGROUND

A call cord is a device that may be used, for example, in a hospital setting or other such healthcare facility. For instance, a bedridden patient can use a call cord to request the attention of a nurse or other care provider. The call cord generally includes a cable (e.g., insulated wire pair) having a length of about 5 to 15 feet. One end of the cable typically includes patient pendant controller, sometimes a handle with a pushbutton switch that the patient can easily hold to summon assistance, though it quite often includes additional functions for television and light control as well. The other end of the cable typically includes a plug that is adapted for connecting with a patient station. The patient station can be wall-mounted or is otherwise proximate the patient's bed, but is readily accessible to an attendant (e.g., so that a call signal can be readily deactivated, or even activated in emergency situations). The patient station is further electronically coupled to a monitor station that might be provided, for instance, at a nurses' station.

In operation, the patient can place a patient call to the monitor station to summon assistance by depressing the call cord pushbutton. This causes a call signal to be generated and transmitted by the patient station to the monitor station. The monitor station attendant can answer the call in person and cancel the call at the patient station, or may answer and simultaneously cancel the call remotely (assuming no emergency situation is present) by speaking with the patient through an intercom system that communicatively couples the monitor and patient stations.

DETAILED DESCRIPTION

A call cord system and connection are disclosed. The system can be implemented in any number of situations where summoning assistance from a remote location is desirable, such as in a healthcare provider setting. In addition, the call cord connection allows the cord to be securely engaged for its intended operation, without concern that the cord will unintentionally become disconnected. However, given sufficient force, the call cord connection further allows the cord to be disconnected from the patient station by the patient or staff without damaging either the call cord itself or the patient station. Such an intentional disconnect can be used, for instance, to signal a patient or staff emergency and a corresponding response, when normal call signaling is not possible (e.g., the patient is not able to depress the call button) or higher priority attention is needed for whatever reason.

System Overview

One potential and non-trivial problem associated with conventional call cord systems is that the call cord can become unintentionally disconnected from the patient station, thereby causing a false call and/or emergency signal and the ensuing response. This problem may be exacerbated in the wake of new standards (e.g., UL 1069, or other such standards) requiring physically heavier call cord constructions, which in turn place more strain on the call cord station-cord interface, or otherwise increase the natural 'hanging' force on the call cord station-cord interface. Thus, a call cord connector that is capable of remaining operatively coupled to the patient station, unless intentionally pulled therefrom, can be used to prevent or otherwise reduce false alarms due to the unintentional disconnect of a patient call cord from its patient station.

Figure 1:
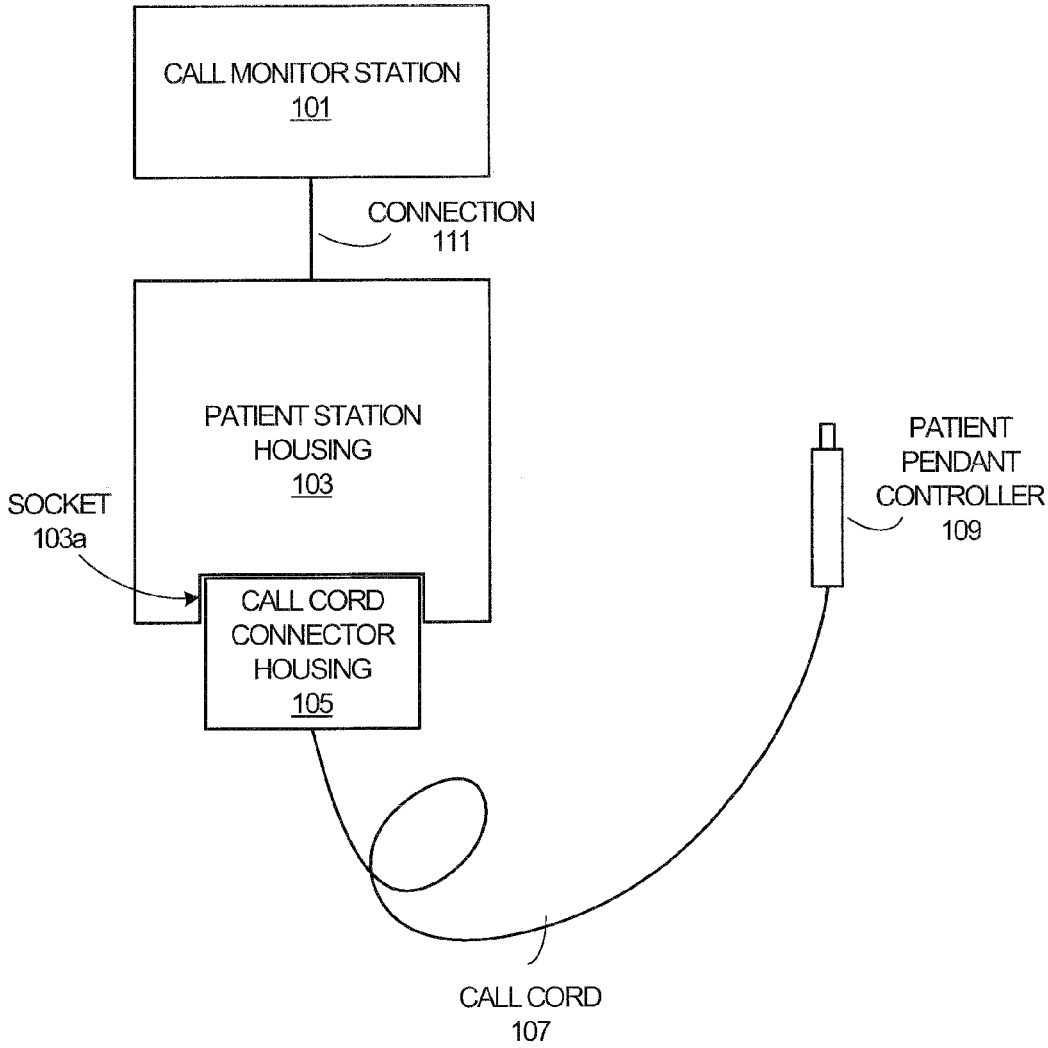
FIG. 1 is a block diagram of a call cord communication system configured in accordance with an embodiment of the present invention.

FIG. 1 is a block diagram of a call cord communication system configured in accordance with an embodiment of the present invention. As can be seen, the system includes a call monitor station 101 that is communicatively coupled via connection 111 with a patient station included in patient station housing 103. A call cord 107 having a patient pendant controller 109 on one end and a call cord connector within call cord connector housing 105 on the other end is also provided. The system can be implemented in accordance with any number of standards, such as UL 1069. The patient station housing 103 includes a socket 103*a* that is adapted to securely couple with the call cord connector housing 105, as will be discussed in detail with reference to FIGS. 2*a-b* and 3*a-c*.

The call monitor station 101 can be implemented with conventional technology, and may include one or more monitors and processing units adapted to receive call signals from the patient station, and generate the appropriate signals so that an appropriate response can be made. The call monitor station 101 may also be configured with telecommunication capability, so as to allow for audio and/or video communication with the person requesting assistance by way of the patient station. The call monitor station 101 may also be configured with other functionality, as will be apparent in light of this disclosure, such as battery back-up, remote call clearing capability, and call forwarding of emergency signals to other monitor stations. These other monitor stations may be, for instance, within the same facility or at a remote facility.

Connection 111 can be implemented, for example, with conventional wired and/or wireless network connections. Any number of suitable communication protocols and direct connection or networking topologies can be employed to realize connection 111, so long as call signals from the patient station can be received by the call monitor station 101. In some embodiments, and as will be appreciated in light of this disclosure, bi-directional communication can be provided, so that communications from the call monitor station 101 can be provided back to the patient station.

The patient station within housing 103 can also be implemented as typically done, and may include one or more processing units adapted to generate call signals in response to the patient pendant controller 109 being engaged (e.g., in response to a pushbutton being depressed and released by patient), and sending those call signals to the call monitor station 101 via the connection 111. The patient station within housing 103 may also be configured with telecommunication capability that is complementary to that of the call monitor station 101, so as to allow for bi-directional audio and/or video communication with the attendant at the call monitor station 101. The patient station with housing 103 may also be configured with other functionality, as will be apparent in light of this disclosure, such as battery back-up, call clearing capability, and vital sign displays.

The call cord 107 can be implemented as typically done (e.g., insulated wire pair). In one particular embodiment, it is implemented in accordance with standard UL 1069. The length of the cord 107 can vary, and in one example case is in the range of 5 to 10 feet long. The patient pendant controller 109 can include any number of functionalities and configurations, such as a simple pushbutton switch or pillow speaker, or a more comprehensive configuration that further includes controls for controlling the local devices, such as a television and lighting fixtures. Alternatively, or in addition to, the patient pendant controller 109 may be configured to accommodate more specific patient needs, such as in the case where the patient cannot operate a pushbutton or pillow speaker. In such cases, the patient pendant controller 109 may be implemented, for example, with a breath-activated device or a pressure pad or a foot pedal. In short, the patient pendant controller 109 can be any mechanism that allows a patient to summon assistance (e.g., pushbutton, speaker, camera and display, etc) and/or control aspects of his or her environment (e.g., television volume and channel, music selection and volume, air-conditioning, bed position, lighting, wheel chair controls, etc). In the example embodiment shown in FIG. 1, the patient pendant controller 109 has a handle shape amenable to easy gripping and a momentary-action pushbutton switch that can be depressed to initiate the call signal process. Numerous other features or variations may be implemented by the system, such as electrostatic discharge (ESD) protection and a latching call button that provides a constant call signal even after release by patient.

Note that some patient stations and housings 103 may be configured to couple with a single call cord 107, while others may be adapted to couple with multiple call cords 107 (e.g., one for each patient in a two bed hospital room). In a multi-call cord application, there may be separate cords 107 and patient pendant controller 109 (e.g., pushbutton switches) for each patient. In such multi-cord applications, there may be a separate call cord connector housing 105 and corresponding socket 103*a* for each call cord 103, or a common interface where each of the separate call cords 107 is joined into a single call cord connector housing 105 adapted for coupling with a single socket 103*a*.

Patient Station Housing

Figure 2A:
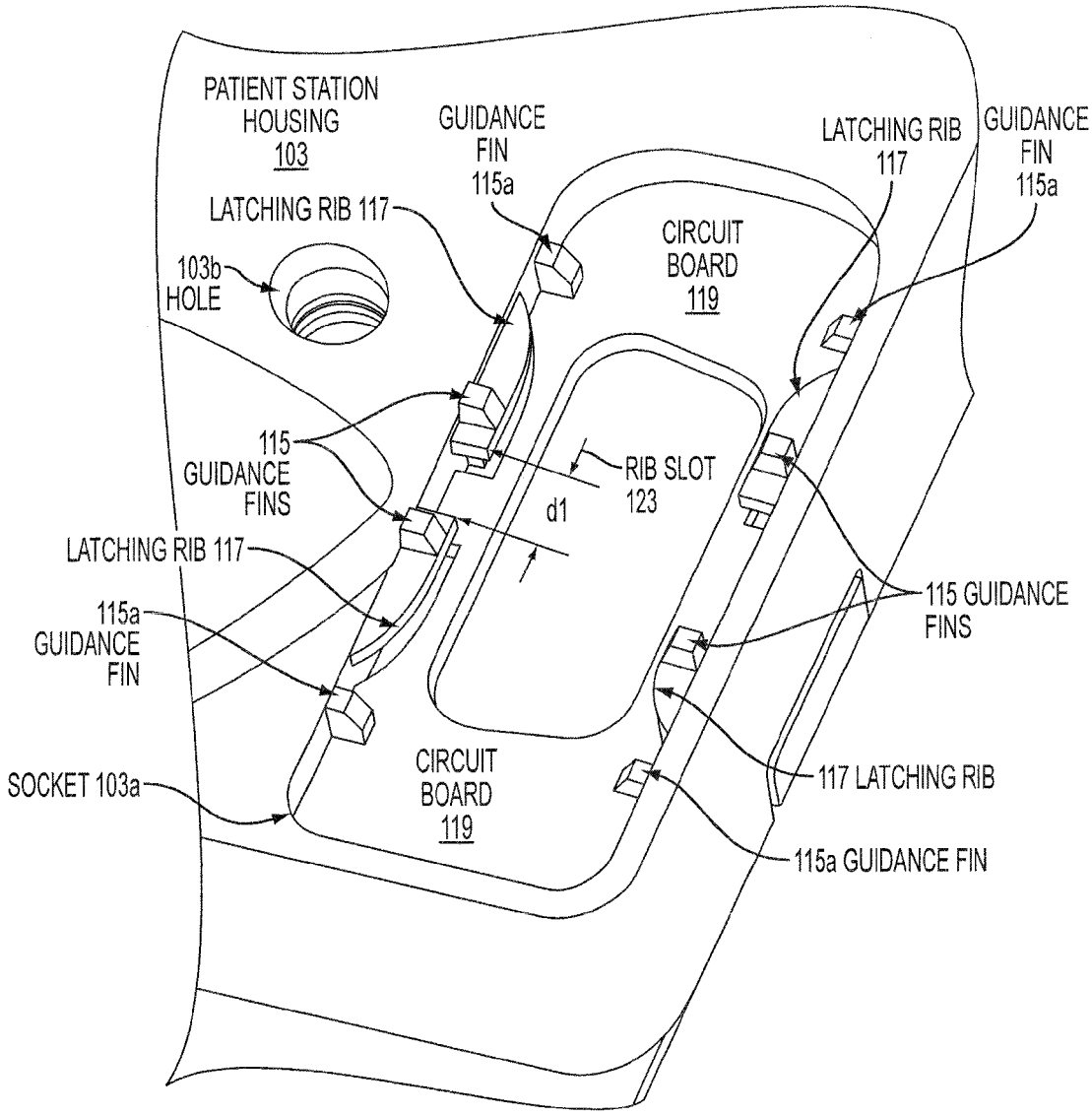
FIGS. 2*a* and 2*b* each show a perspective view of a patient station housing configured in accordance with an embodiment of the present invention.
Figure 2B:
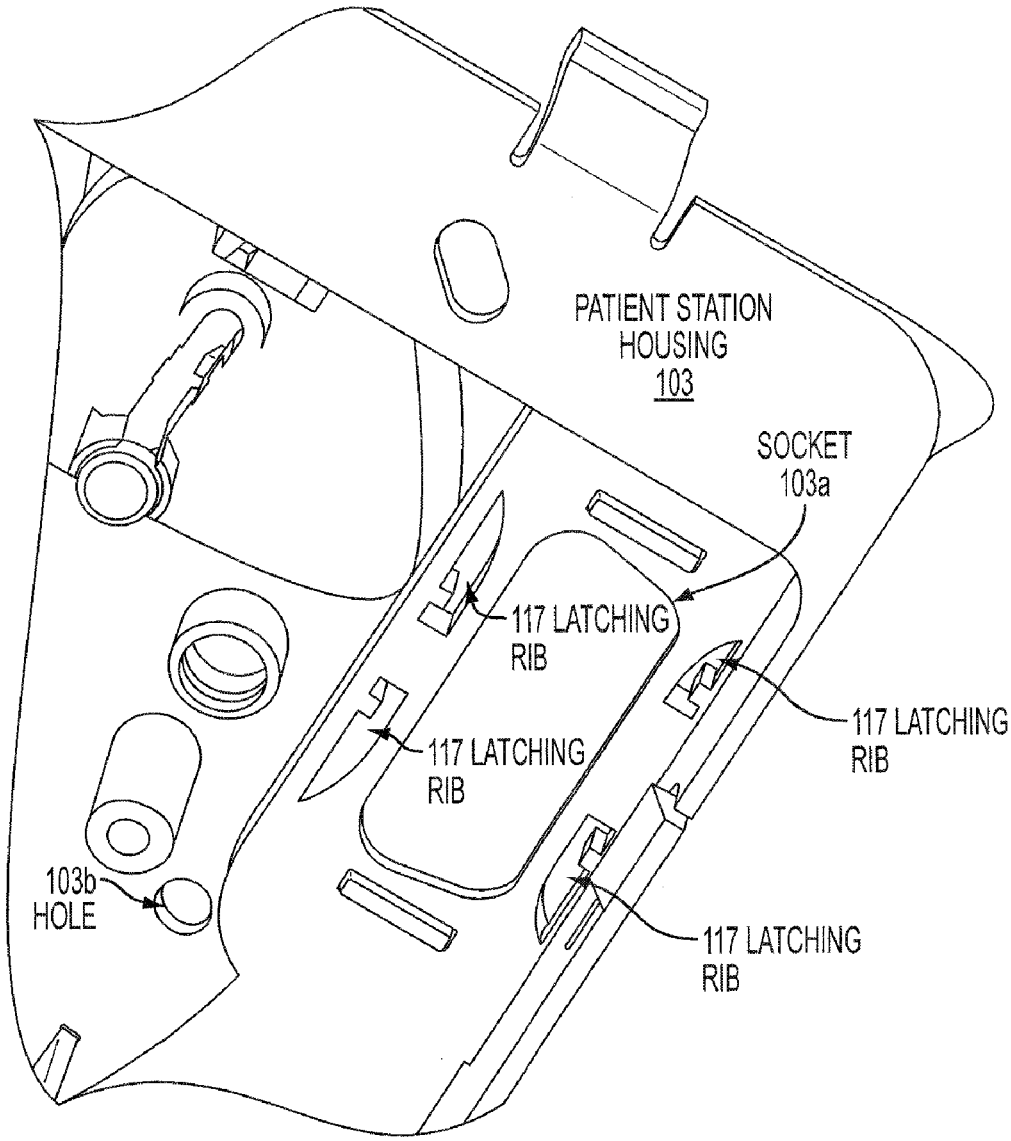

FIGS. 2*a* and 2*b* each show a perspective view of a patient station housing 103 configured in accordance with an embodiment of the present invention. The housing 103 may be fabricated, for example, from high impact plastic using injection molding techniques. Alternatively, the housing can be fabricated from metal using standard pressing, stamping, and/or machining processes.

In this example embodiment, the housing 103 includes socket 103*a* and hole 103*b*. As can be further seen, a circuit board 119 is deployed within housing. The circuit board 119 can be, for example, a printed circuit board with components operatively coupled thereon that provide the desired patient station functionality. The hole 103*b* is used to accommodate a patient station feature, such as a light emitting diode (LED) or a call initiate/cancel button. The socket 103*a* includes a number of guidance fins 115/115*a* and latching ribs 117 disposed around its perimeter, which are configured to engage with resilient flanges 105*a* (as best shown in FIG. 3*c*) disposed on the sides of the call cord connector housing 105. More particularly, the guidance fins 115 allow the resilient flanges 105*a* to effectively compress inward while pushing past the latching ribs 117 of the housing 103. Once passed the latching ribs 117, the resilient flanges 105*a* then extend outward toward their natural position, so that they form a catch or ridge under the latching ribs 117. In this way, the housing 103 and housing 105 are operatively coupled to one another, and only a particular amount of force will separate them. This particular amount of force is generally a force that is greater than the force associated with the natural weight of the call cord assembly under normal non-pulling use.

In more detail, and with continued reference to FIGS. 2*a* and 2*b*, the socket 103*a* of this example embodiment has four guidance fins 115—two on each of its longest sides. As can be seen, the guidance fins 115 on the right side of socket 103*a* are directly opposing guidance fins 115 on the left side of socket 103*a*. However, in other embodiments, the guidance fins 115 need not be directly opposing (same applies to guidance fins 115*a*). These guidance fins 115 are configured with a slope that tapers inward toward to the center of the socket 103*a*, so as guide the call cord connector housing 105 into the socket 103*a*, during initial phase of the engagement. The housing 105 may be configured with grooves that correspond to the guidance fins 115, so that the fins 115 not only act as a guide, but also further operate to align the housing 105 as it is being inserted. Such grooves would be wider than the width of the fins 115, so as to provide an aligning function but not impede an intentional disconnection of housing 105 from housing 103 based on forces applied in various directions (e.g., up, sideways, or angled pulling force). The socket 103*a* further includes one or more latching ribs 117, and more specifically, this example embodiment includes four elongated latching ribs 117. The four outermost narrow guidance fins 115*a* are configured with a slope that tapers inward in a similar fashion as the guidance fins 115, but are positioned lower in socket 103*a* relative to the fins 115 so as to continue guiding the call cord connector housing 105 into the socket 103*a*, during the middle/end phase of the engagement. The elongated latching ribs 117 operate in conjunction with the fins 115/115*a*, and provide additional ridge area to trap the flanges 105*a* of the housing 105. In some embodiments, the taper of the guidance fins 115 and 115*a* can be about a 15 to 35 degree inward taper as variously shown in FIGS. 2*a* and 3*a*-3*c*). In a similar fashion, the underside of the latching ribs 117 can be tapered upward with about a 5 to 25 degree upward taper as shown, for example, in FIG. 3*c*. Further note that the flanges 105*a* may be configured with a complementary taper. Such an optional tapering scheme can be used to further assist in a smoother disengaging action during intentional disconnects.

In one example configuration, the fins 115 and 115*a* are each about 1/16 to 1/4 inches wide, and have an inward taper of about 20 degrees. Also, the elongated ribs 117 are about 1/2 to 1 inches wide, and the underside each rib 117 has an upward taper of about 10 degrees with the narrowest part of the taper being about 1 mm (about 0.04 inches). The ribs 117 each extend inward about the same distance (e.g., about 1 to 2 mm) toward the center of socket 103*a*, so as to provide a uniform ridge profile to catch the corresponding flange 105*a*. Other embodiments may be configured differently, and include a tab-and-groove connection on one side of the cord connection interface and one rib-and-flange on the other side of the connection interface. For instance, in one such case, housing 105 may have one or more tabs on one side and a flange on the other side. Socket 103*a* of housing 103 would have the corresponding slots aligned to mate with the tabs of housing 105, and a latching rib (narrow and/or elongated) on the opposing side of the socket 103*a*, to mate with the flange of the housing 105. Alternatively, the tabs can be part of the housing 103 and the housing 105 can be configured with the complementary slots. In another alternative embodiment, elongated ribs 117 may each be replaced or supplemented with one or more narrower ribs (e.g., each about 1/16 to 1/4 inches wide) that are suitably positioned to catch flange 105*a*. Numerous dimensional schemes involving one or more ribs 117 and any number of optional fins 115/115*a* will be apparent in light of this disclosure, and the present invention is not intended to be limited to any particular scheme. In a more general sense, housings 103 and 105 can be configured with any resilient catch-release mechanism suitable for quick disconnect in response to an intentionally applied force typical of a call cord pull by patient or attendant, as described herein.

In general, the patient station housing 103 and call cord connector housing 105 can be sized and dimensioned to suit the given application and desired form factor. In one example embodiment, the patient station housing 103 is a wall mountable unit that is about 5 to 6 inches square and has a depth of about 2 inches. The call cord connector housing 105 is about 0.5 inches wide and about 1.5 inches long and about 1.5 to 2 inches tall (not counting the cord 107). As will be appreciated, the actual housing dimensions will depend on factors such as the types of connectors employed (105*b* and 119*a*) and the complexity of features/functions provided by the system. Other such suitable sizing and dimensional details will be apparent in light of this disclosure.

Figure 3A:
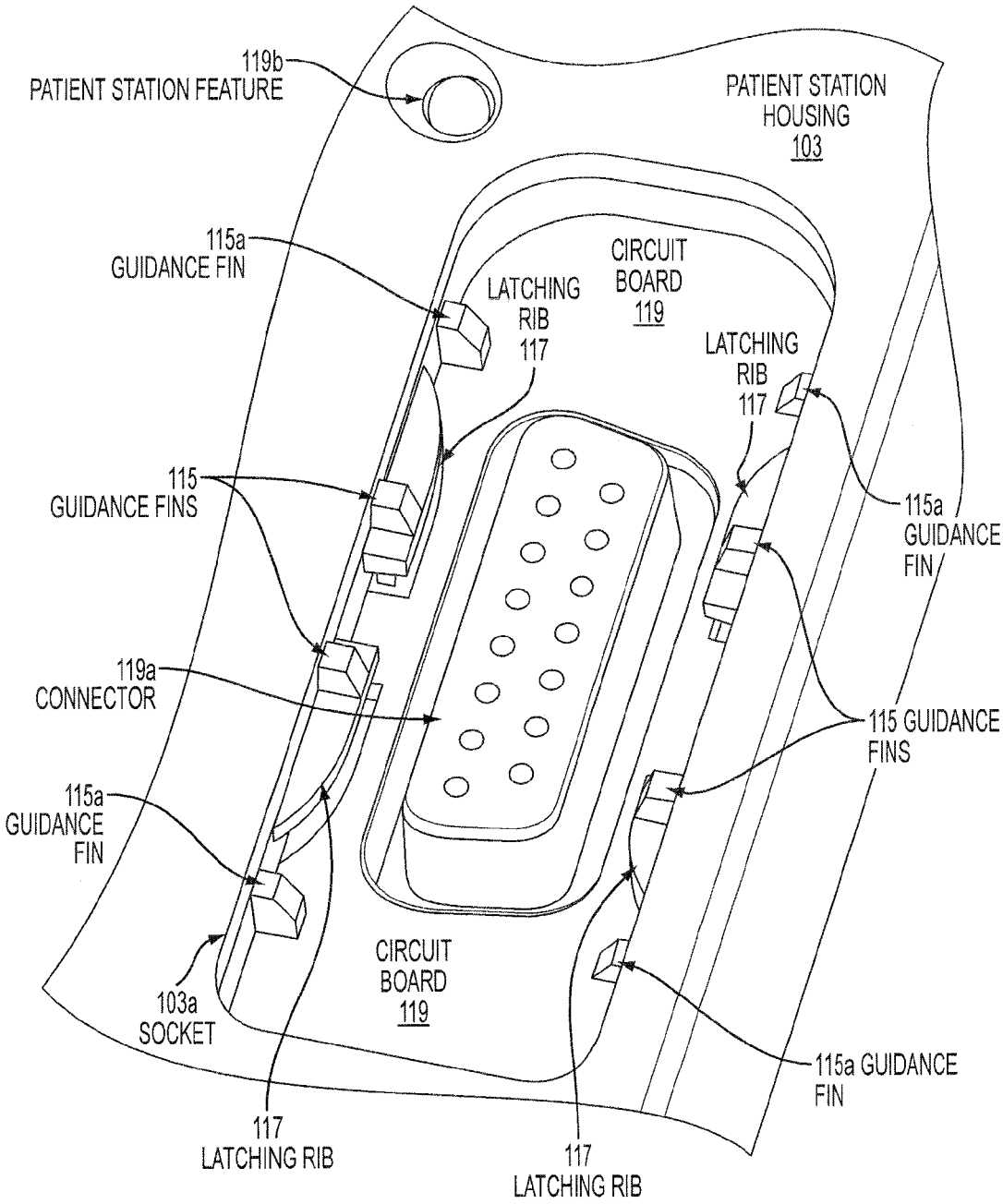
FIG. 3*a* is a perspective view of the patient station housing shown in FIGS. 2*a* and 2*b,* with additional features included, in accordance with an embodiment of the present invention.

FIG. 3*a* is a perspective view of the patient station housing 103 shown in FIGS. 2*a* and 2*b*, with additional features included, in accordance with an embodiment of the present invention. The additional features in this example include patient station feature 119*b* and connector 119*a*, each of which are operatively coupled with the circuit board 119 (e.g., via solder connections). Patient feature 119*b* may be, for example, an LED indicator that reflects the status of the call (e.g., active or cancelled), or a call cancel/initiate button. Any number of typical patient station features can be implemented here. The connector 119*a* is a standard 15 pin sub-D connector, although any number of standard connections can be used in conjunction with the cord connector techniques described herein.

Call Cord Connector

Figure 3B:
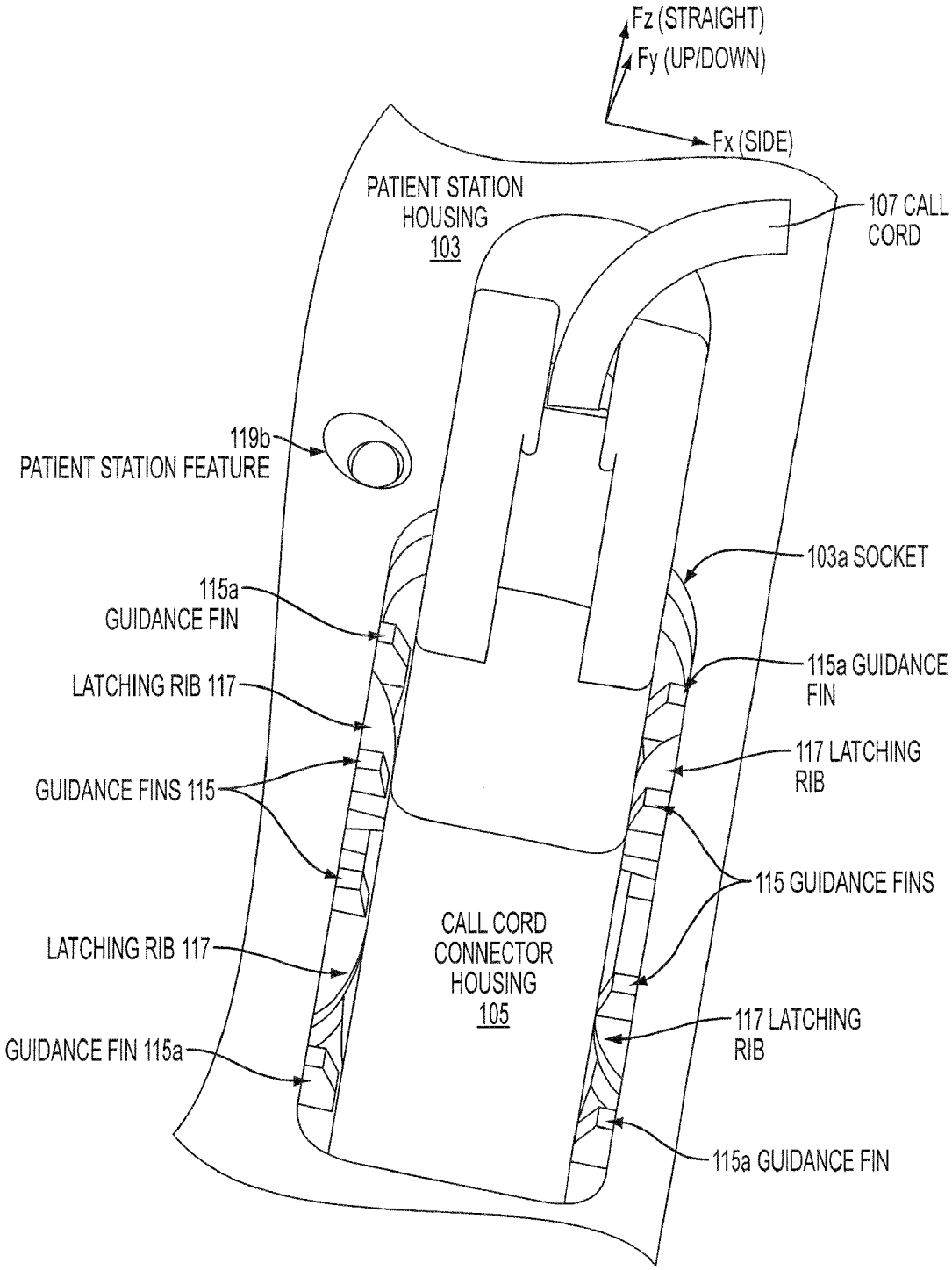
FIG. 3*b* is a perspective view of the patient station housing shown in FIG. 3*a* operatively coupled with a call cord connector housing, in accordance with an embodiment of the present invention.
Figure 3C:
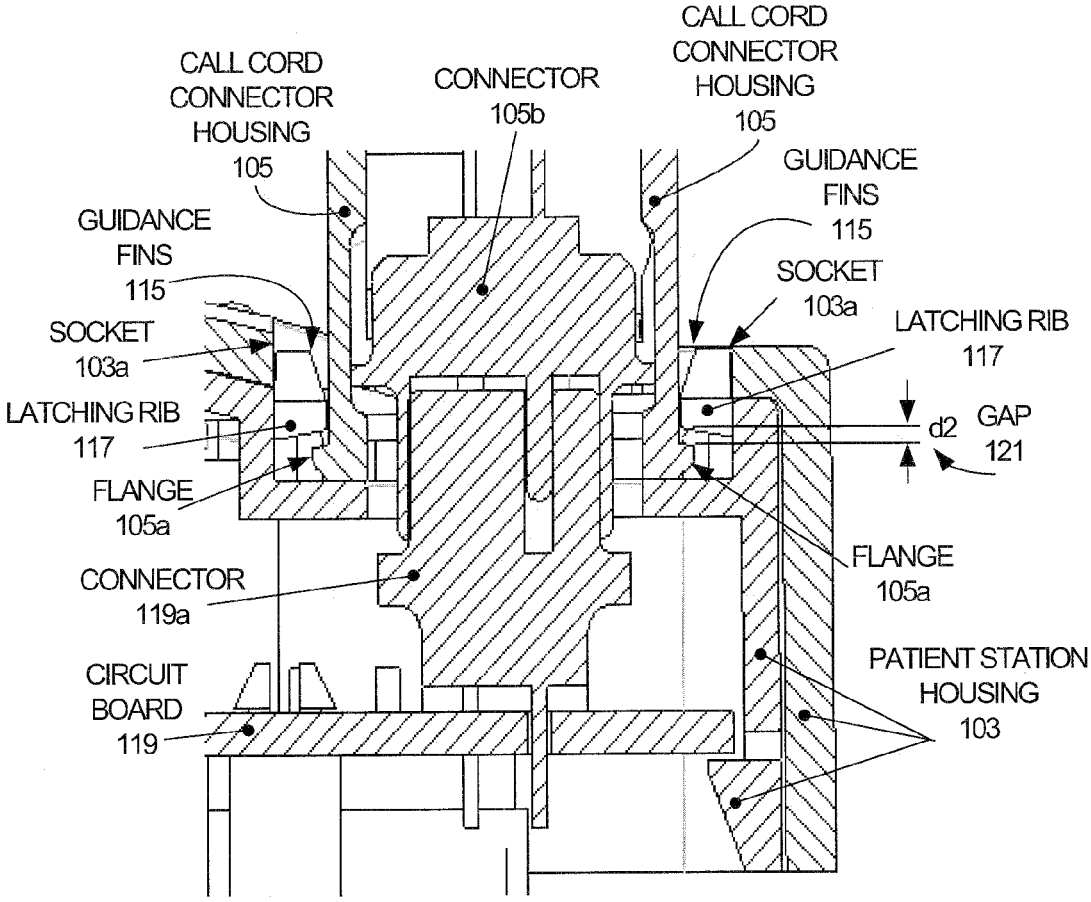
FIG. 3*c* is a cross-sectional view of the operatively coupled patient station housing and call cord connector housing shown in FIG. 3*b,* in accordance with an embodiment of the present invention.

FIG. 3*b* is a perspective view of the patient station housing 103 shown in FIG. 3*a* operatively coupled with a call cord connector housing 105, in accordance with an embodiment of the present invention, and FIG. 3*c* shows a cross-sectional view of same. As best seen in FIG. 3*c*, the call cord connector housing 105 has two flanges 105*a*, one on each side of its longest sides. When the call cord connector housing 105 is connected to the patient station housing 103, these flanges 105*a* reside under the latching ribs 117 on the patient station socket 103*a*, and keep the call cord connector within housing 105 operatively connected to the patient station within housing 103. When the cord 107 is moved around during normal use, this energy or force is not sufficient to cause the connection between housing 103 and 105 to disconnect, but if enough pull force is applied, the call cord connector housing 105 will disengage from the socket 103*a* without breaking either component.

In more detail, and in accordance with the example embodiment shown in FIG. 3*c*, when used in normal operation, the flanges 105*a* and ribs 117 provide sufficient resistance to maintain connection of the two housings 105 and 103. When an emergency condition warrants, the staff or patient can intentionally pull the cord from the patient station socket 103*a*, which signals, for example, a higher level priority call in the system (relative to a regular call initiated via the pushbutton), bringing immediate attention to the healthcare provider staff to provide a quick response.

With reference to FIG. 2*a*, note rib slot 123 having a distance d1 between the latching ribs 117. This slot allows for a length of the corresponding flange 105 to be free of rib contact, so that the holding power of the connection interface between housing 105 and socket 103*a* is not so great as to prevent an intentional pull force from disengaging the housing 105 from socket 103*a*. In one example embodiment, this distance d1 is in the range 5.0 to 20.0 mm, and even more specifically, about 10.0 mm. With further reference to FIG. 3*c*, note the gap 121 having a distance d2 between the lip of the flange 105*a* and the adjacent face of rib 117. This gap allows for a degree of play, so that the holding power of the connection interface between housing 105 and socket 103*a* is not so great as to prevent an intentional pull force from disengaging the housing 105 from socket 103*a*. In one example embodiment, this distance d2 is in the range 0.1 to 1.5 mm, and even more specifically, about 0.6 mm. As will be appreciated, the dimensions of features such as the rib slot 123 and the gap 121, which are optional features, will vary depending on factors such as the overall size of the connection interface between housing 105 and socket 103*a*.

Example pull force measurements for an embodiment having a gap 121 distance (d2) of about 0.6 mm and a rib slot 123 distance (d1) of about 10 mm are shown in Table 1. The force (in Newtons) in each of the X, Y, and Z directions (as shown in FIG. 3*b*) as actually measured in ten distinct disconnection events, along with corresponding averages, minimums and maximums, modes, and standard deviations, are provided.

TABLE 1

| # | Fx | Fy | Fz |
|---|---|---|---|
| 1 | 17.00 | 50.00 | 40.00 |
| 2 | 16.00 | 47.50 | 40.00 |
| 3 | 17.00 | 50.00 | 35.00 |
| 4 | 17.00 | 47.50 | 37.50 |
| 5 | 15.00 | 47.50 | 40.00 |
| 6 | 12.50 | 45.00 | 37.50 |
| 7 | 15.00 | 45.00 | 35.00 |
| 8 | 12.50 | 47.50 | 35.00 |
| 9 | 12.50 | 42.50 | 35.00 |
| 10 | 16.50 | 42.50 | 35.00 |
| Avg | 15.10 | 46.50 | 37.00 |
| Min | 12.50 | 42.50 | 35.00 |
| Max | 17.00 | 50.00 | 40.00 |
| Mode | 17.00 | 47.50 | 35.00 |
| Stan Dev | 1.94 | 2.69 | 2.30 |

As can be seen, the average force in the X direction (Fx) is about 15.1 Newtons, the average force in the Y direction (Fy) is about 46.5 Newtons, and the average force in the Z direction (Fz) is about 37.0 Newtons. Thus, most of the force required in the disconnect is in the Y (e.g., up) and Z (e.g., straight back or angled) directions. The actual forces associated with disconnecting a call cord connection configured in accordance with an embodiment of the present invention may vary significantly, and may be set as desired, given the particulars of a given application. In any such cases, the call cord connection remains intact during normal usage, and only disconnects in response to intentional disconnect forces. As will be appreciated, an accidental but significant force applied to the call cord connection, such as that associated when a patient inadvertently walks too far from the patient station 103 with the patient pendant controller 109 in his/her bathrobe pocket or secured under the bathrobe tie, can be considered an intentional force in the context of this disclosure.

In some example embodiments of the present invention, an intentional disconnect force is as follows: a force in the X direction (Fx) of about 10.0 Newtons or higher, a force in the Y direction (Fy) of about 25.0 Newtons or higher, and a force in the Z direction (Fz) of about 15.0 Newtons or higher. In a more general case, an intentional disconnect force is any force that is greater than the force that is normally applied to the call cord due to the weight and motion of the cord itself during typical connected usage by a patient.

Thus, numerous embodiments will be apparent in light of this disclosure. One example such embodiment includes a call cord connection system. The system includes a call cord connector housing having a mechanical coupling mechanism on an outside wall of the call cord connector housing, the mechanical coupling mechanism for operatively coupling with a complementary mechanical coupling mechanism of a corresponding socket to which the call cord connector housing is designed to engage, so as to hold the call cord connector housing in the socket, unless an intentional disconnect force is applied. The system further includes a call cord configured with a patient pendant controller at a first end and the call cord connector housing at a second end, the patient pendant controller configured with a call activation mechanism. In one such embodiment, the mechanical coupling mechanism on an outside wall of the call cord connector housing is a resilient flange, and the complementary mechanical coupling mechanism of a corresponding socket is a latching rib. In one such case, the call cord connector housing has a resilient flange on each of two opposing outside walls, and the socket has a plurality of latching ribs. In some instances, at least one of the ribs is elongated relative to the others of the latching ribs. In some embodiments, once the call cord connector housing is engaged in the socket, there is a gap that allows for a degree of play between the resilient flange and the latching rib. The system may include the socket, wherein the socket is included in a patient station housing. In one such case, the socket includes one or more tapered guidance fins, for allowing the mechanical coupling mechanism on an outside wall of the call cord connector housing to compress inward while pushing past the complementary mechanical coupling mechanism of a corresponding socket during initial phase of engagement between the call cord connector housing and the socket. In another such case, the patient station housing has deployed therein electronics and an electrical connector for electronically coupling with an electronic connector deployed in the call cord connector housing. In another such case, the system includes a monitor station communicatively coupled with a patient station deployed within the patient station housing.

Another example embodiment includes call cord connection system, which includes a patient station housing having a socket for mechanical connection to a call cord connector housing, and a call cord connector housing having a mechanical coupling mechanism on an outside wall of the call cord connector housing, the mechanical coupling mechanism for operatively coupling with a complementary mechanical coupling mechanism of the socket, so as to hold the call cord connector housing in the socket, unless an intentional disconnect force is applied. The system further includes a call cord configured with a patient pendant controller at a first end and the call cord connector housing at a second end, the patient pendant controller configured with a call activation mechanism. The patient station housing has deployed therein electronics and an electrical connector for electronically coupling with an electronic connector deployed in the call cord connector housing. In one such case, the mechanical coupling mechanism on an outside wall of the call cord connector housing is a resilient flange, and the complementary mechanical coupling mechanism of a corresponding socket is a latching rib. In one such particular case, the call cord connector housing has a resilient flange on each of two opposing outside walls, and the socket has a plurality of latching ribs. In another such particular case, the socket further includes one or more tapered guidance fins, for allowing the at least one resilient flange to compress inward while pushing past the at least one latching rib during initial phase of engagement between the call cord connector housing and the socket. In another such particular case, once the call cord connector housing is engaged in the socket, there is a gap that allows for a degree of play between the mechanical coupling mechanism on an outside wall of the call cord connector housing and the complementary mechanical coupling mechanism of the socket.

Another example embodiment includes call cord connection system, which includes a patient station housing having a socket configured with a mechanical coupling mechanism for operatively coupling with a complementary mechanical coupling mechanism on an outside wall of a corresponding call cord connector housing, so as to hold the call cord connector housing in the socket, unless an intentional disconnect force is applied. The patient station housing has deployed therein electronics and an electrical connector for electronically coupling with an electronic connector deployed in the call cord connector housing. In one such case, the system further includes the call cord connector housing. In another such case, the complementary mechanical coupling mechanism on an outside wall of a corresponding call cord connector housing is a resilient flange, and the mechanical coupling mechanism of the socket is a latching rib. In one such particular case, the call cord connector housing has a resilient flange on each of two opposing outside walls, and the socket has a plurality of latching ribs. Here, at least one of the ribs may be elongated relative to the others of the latching ribs. Once the call cord connector housing is engaged in the socket, there may be a gap that allows for a degree of play between the resilient flange and the latching rib. The socket may include one or more tapered guidance fins, for allowing the complementary mechanical coupling mechanism on an outside wall of a corresponding call cord connector housing to compress inward while pushing past the mechanical coupling mechanism of the socket during initial phase of engagement between the call cord connector housing and the socket.

The foregoing description of the embodiments of the disclosure has been presented for the purposes of illustration and description. It is not intended to be exhaustive or to limit the disclosure to the precise forms disclosed. Many modifications and variations are possible in light of this disclosure. It is intended that the scope of the disclosure be limited not by this detailed description, but rather by the claims appended hereto.

What is claimed is:

1. A call cord connection system, comprising:

a call cord connector housing having a resilient flange on an outside wall of the call cord connector housing, the resilient flange for operatively coupling with a latching rib of a socket to which the call cord connector housing is designed to engage, so as to hold the call cord connector housing in the socket, unless an intentional disconnect force is applied, wherein once the call cord connector housing engages the socket, there is a gap between the resilient flange and the latching rib that allows for a degree of play between the resilient flange and the latching rib, the gap being in the range of 0.1 mm to 1.5 mm; and a call cord configured with a patient pendant controller at a first end and the call cord connector housing at a second end, the patient pendant controller configured with a call activation mechanism.

2. The system of claim 1 wherein the call cord connector housing has a resilient flange on each of two opposing outside walls, and the socket has a plurality of latching ribs.

3. The system of claim 2 wherein at least one of the latching ribs is elongated relative to the others of the latching ribs.

4. The system of claim 1 further comprising the socket, wherein the socket is included in a patient station housing.

5. A call cord connection system, comprising:

a call cord connector housing having a mechanical coupling mechanism on an outside wall of the call cord connector housing, the mechanical coupling mechanism for operatively coupling with a complementary mechanical coupling mechanism of a socket to which the call cord connector housing is designed to engage, so as to hold the call cord connector housing in the socket, unless an intentional disconnect force is applied, the call cord connector housing further configured to couple with a call cord; and a patient station housing including the socket, the socket having one or more tapered guidance fins, for allowing the mechanical coupling mechanism on the outside wall of the call cord connector housing to compress inward while pushing past the complementary mechanical coupling mechanism of the socket during initial phase of engagement between the call cord connector housing and the socket.

6. The system of claim 5 wherein the mechanical coupling mechanism on the outside wall of the call cord connector housing is a resilient flange, and the complementary mechanical coupling mechanism of the socket is a latching rib.

7. The system of claim 5 wherein once the call cord connector housing is engaged in the socket, there is a gap between the mechanical coupling mechanism on the outside wall of the call cord connector housing and the complementary mechanical coupling mechanism of the socket, the gap allowing for a degree of play between the mechanical coupling mechanism on the outside wall of the call cord connector housing and the complementary mechanical coupling mechanism of the socket, the gap being in the range of 0.1 mm to 1.5 mm.

8. The system of claim 5 wherein the patient station housing has deployed therein electronics and an electrical connector for electronically coupling with an electronic connector deployed in the call cord connector housing, the electrical connector of the patient station housing accessible via the socket.

9. The system of claim 5 further comprising:

a monitor station communicatively coupled with a patient station deployed within the patient station housing.

10. A call cord connection system, comprising:

a patient station housing having a socket;

a call cord connector housing having a resilient flange on an outside wall of the call cord connector housing, the resilient flange for operatively coupling with a latching rib of the socket, so as to hold the call cord connector housing in the socket, unless an intentional disconnect force is applied; and a call cord configured with a patient pendant controller at a first end and the call cord connector housing at a second end, the patient pendant controller configured with a call activation mechanism;

wherein the socket has one or more tapered guidance fins, for allowing the resilient flange to compress inward while pushing past the latching rib during initial phase of engagement between the call cord connector housing and the socket; and wherein the patient station housing has deployed therein electronics and an electrical connector for electronically coupling with an electronic connector deployed in the call cord connector housing, the electrical connector of the patient station housing accessible via the socket.

11. The system of claim 10 wherein the call cord connector housing has a resilient flange on each of two opposing outside walls, and the socket has a plurality of latching ribs.

12. A call cord connection system, comprising:

a patient station housing having a socket;

a call cord connector housing having a resilient flange on an outside wall of the call cord connector housing, the resilient flange for operatively coupling with a latching rib of the socket, so as to hold the call cord connector housing in the socket, unless an intentional disconnect force is applied; and a call cord configured with a patient pendant controller at a first end and the call cord connector housing at a second end, the patient pendant controller configured with a call activation mechanism;

wherein once the call cord connector housing is engaged in the socket, there is a gap between the resilient flange on the outside wall of the call cord connector housing and the latching rib of the socket, the gap allowing for a degree of play between the resilient flange on the outside wall of the call cord connector housing and the latching rib of the socket, the gap being in the range of 0.1 mm to 1.5 mm; and wherein the patient station housing has deployed therein electronics and an electrical connector for electronically coupling with an electronic connector deployed in the call cord connector housing, the electrical connector of the patient station housing accessible via the socket.

13. The system of claim 12 wherein the call cord connector housing has a resilient flange on each of two opposing outside walls, and the socket has a plurality of latching ribs.

14. The system of claim 12 wherein the socket further comprises:

one or more tapered guidance fins, for allowing the resilient flange to compress inward while pushing past the latching rib during initial phase of engagement between the call cord connector housing and the socket.

15. A call cord connection system, comprising:

a patient station housing having a socket configured with a latching rib for operatively coupling with a resilient flange on an outside wall of a call cord connector housing, so as to hold the call cord connector housing in the socket, unless an intentional disconnect force is applied;

wherein once the call cord connector housing is engaged in the socket, there is a gap between the resilient flange and the latching rib that allows for a degree of play between the resilient flange and the latching rib, the gap being in the range of 0.1 mm to 1.5 mm; and wherein the patient station housing has deployed therein electronics and an electrical connector for electronically coupling with an electronic connector deployed in the call cord connector housing, the electrical connector of the patient station housing accessible via the socket.

16. The system of claim 15 further comprising the call cord connector housing.

17. The system of claim 16 wherein the call cord connector housing has a resilient flange on each of two opposing outside walls, and the socket has a plurality of latching ribs.

18. The system of claim 17 wherein at least one of the latching ribs is elongated relative to the others of the latching ribs.

19. A call cord connection system, comprising:

a patient station housing having a socket configured with a mechanical coupling mechanism for operatively coupling with a complementary mechanical coupling mechanism on an outside wall of a call cord connector housing, so as to hold the call cord connector housing in the socket, unless an intentional disconnect force is applied;

wherein the patient station housing has deployed therein electronics and an electrical connector for electronically coupling with an electronic connector deployed in the call cord connector housing, the electrical connector of the patient station housing accessible via the socket; and wherein the socket further comprises one or more tapered guidance fins, for allowing the complementary mechanical coupling mechanism on the outside wall of the call cord connector housing to compress inward while pushing past the mechanical coupling mechanism of the socket during initial phase of engagement between the call cord connector housing and the socket.

20. The system of claim 19 wherein the complementary mechanical coupling mechanism on the outside wall of the call cord connector housing is a resilient flange, and the mechanical coupling mechanism of the socket is a latching rib.

21. The system of claim 19 wherein once the call cord connector housing is engaged in the socket, there is a gap between the mechanical coupling mechanism on the outside wall of the call cord connector housing and the complementary mechanical coupling mechanism of the socket, the gap allowing for a degree of play between the mechanical coupling mechanism on the outside wall of the call cord connector housing and the complementary mechanical coupling mechanism of the socket, the gap being in the range of 0.1 mm to 1.5 mm.

* * * * *